US007596057B2

(12) United States Patent
Linder et al.

(10) Patent No.: US 7,596,057 B2
(45) Date of Patent: Sep. 29, 2009

(54) CHRONOGRAPH WATCH WITH RETROGRADE DISPLAY

(75) Inventors: Stephane Linder, Neuchatel (CH); Thomas Houlon, Boudry (CH); Marc-Andre Glassey, Bramois (CH)

(73) Assignee: TAG Heuer SA, Marin (CH)

( * ) Notice: Subject to any disclaimer, the term of this patent is extended or adjusted under 35 U.S.C. 154(b) by 0 days.

(21) Appl. No.: 11/505,690

(22) Filed: Aug. 17, 2006

(65) Prior Publication Data

US 2006/0280037 A1 Dec. 14, 2006

Related U.S. Application Data

(63) Continuation of application No. PCT/EP2005/050489, filed on Feb. 4, 2005.

(30) Foreign Application Priority Data

Feb. 17, 2004 (CH) ..... 2004CH-00239

(51) Int. Cl.
*G04B 19/04* (2006.01)

(52) U.S. Cl. ..... 368/80; 368/228

(58) Field of Classification Search ..... 368/110, 368/102, 62, 80, 101, 113, 223, 228, 76, 368/107, 103–106; D10/38–39
See application file for complete search history.

(56) References Cited

U.S. PATENT DOCUMENTS

| | | | | |
|---|---|---|---|---|
| 4,270,197 | A * | 5/1981 | Minowa | 368/102 |
| 5,119,349 | A * | 6/1992 | Muto et al. | 368/157 |
| 5,151,885 | A * | 9/1992 | Kasuo | 368/110 |
| 5,166,912 | A | 11/1992 | Kanesaka | |
| 5,251,190 | A * | 10/1993 | Miyasaka et al. | 368/10 |
| 5,469,410 | A * | 11/1995 | Berney | 368/28 |
| 5,943,299 | A * | 8/1999 | Genta | 368/28 |
| 5,959,941 | A * | 9/1999 | Murakami et al. | 368/80 |
| 6,570,823 | B1 * | 5/2003 | Gilomen et al. | 368/113 |
| 6,597,637 | B2 * | 7/2003 | Wyssbrod | 368/110 |
| 6,896,403 | B1 * | 5/2005 | Grau | 368/190 |
| 6,975,562 | B2 * | 12/2005 | Lizzi | 368/69 |
| 2004/0233788 | A1 * | 11/2004 | Plancon et al. | 368/11 |
| 2005/0162982 | A1 * | 7/2005 | Suzuki | 368/145 |

FOREIGN PATENT DOCUMENTS

| | | |
|---|---|---|
| CH | 61025 | 9/1912 |
| EP | 130 150 | 6/1984 |
| EP | 1 024 416 A2 | 8/2000 |
| EP | 1 085 384 A1 | 3/2001 |
| EP | 1 211 579 A1 | 6/2002 |
| WO | WO 02/093273 A1 | 11/2002 |

* cited by examiner

*Primary Examiner*—Renee S Luebke
*Assistant Examiner*—Sean Kayes
(74) *Attorney, Agent, or Firm*—Pearne & Gordon LLP

(57) ABSTRACT

The invention relates to a chronograph watch with a display with a first retrograde hand for indicating the tenths of a second of the chronograph and a second retrograde hand for displaying the hundredths of a second of the chronograph. The hours, minutes and seconds are displayed by corresponding hands at the center of the dial.

32 Claims, 4 Drawing Sheets

CHRONOGRAPH WATCH WITH RETROGRADE DISPLAY

REFERENCE DATA

This application is a continuation of International Patent Application PCT/EP2005/050489 (WO2005/091086) filed on Feb. 4, 2005, claiming priority of Swiss patent application 2004CH-00239 of Feb. 17, 2004, the contents whereof are hereby incorporated.

FIELD OF THE INVENTION

The present invention concerns a chronograph watch and a movement for chronograph watch. The present invention concerns in particular a chronograph watch characterized by a new principle for displaying the counted period.

DESCRIPTION OF RELATED ART

Chronograph watches can function according to at least two different modes. One operating mode allows the current time to be displayed whilst the other mode allows the accurate duration of an event to be measured and displayed.

Certain electronic quartz chronographs make it possible to count durations with a resolution of a tenth or even a hundredth of second. However, in the case of a wristwatch with analog display, the space available on the dial for displaying the chronograph's indications is limited. For this reason, the displaying of the chronograph's indications, in particular of the tenths and of the hundredths, is the result of a compromise that is rarely satisfactory.

The usual chronograph watches often comprise three concentric hands at the centre and several small hands on sub-dials. In this text, whenever one mentions a hand at the center, one means hands placed at the center of the dial or close to this centre, and whose extremity runs the main graduation close to the dial's periphery.

In time display mode, the three hands at the centre indicate the current hour, minute and second respectively, whilst the hands of the sub-dials remain unused. In chronograph mode, the hours, minutes and seconds of the counted duration are generally indicated by the small hands of the sub-dials, whilst the tenths of seconds can be indicated by the central seconds hand. Other attributions of the hands in chronograph mode are also known.

Reading the duration counted by this type of chronograph is slow and not very intuitive. On the one hand, considerable duration variations are indicated only by minimal displacements of a small de-centered hand. On the other hand, the hour, minute and second indications are displayed by a first set of hands in time display mode and by a different set of hands in chronograph mode; the user must thus first understand which hand is assigned to which indication in each mode. The circular sub-dials have a small diameter that does not allow highly visible indexes to be placed there. It is counter-intuitive to use the small de-centered hands for displaying important durations and the larger hands at the center for fractions of this duration. Finally, the hands at the centre must be driven in chronograph mode at angular speeds much greater than those that are used during time display; flexible driving motors are thus required for driving these hands, whilst the current consumption caused by this fast displacement of large-size hands is considerable.

Chronograph watches with a retrograde display of the counted minutes or hours are also known. By retrograde display, we will mean in this text a display by means of a hand that can revert to its initial position only by means of an angular displacement in the opposite direction to the sense of rotation used during the measurement. Retrograde displays comprise a graduation along an open curve, for example along a segment of circle, which allows larger-size indexes to be used. However, also in this case, hour or minute indications are borne by a central hand in time display mode and by a different retrograde hand in chronograph mode. The interpretation of the displayed data is thus complex. On the other hand, the retrograde display of the counted hours restricts the maximum duration that can be counted and displayed intuitively; the hand cannot indicate a value greater than that which is at the end of the graduation.

Also known are chronograph watches that display the current time by means of concentric hands at the centre, and the duration counted by the chronograph by means of an additional numeric display. The numeric display increases the price of the watch and causes additional aesthetic constraints.

U.S. Pat. No. 5,166,912 describes a chronograph watch comprising a retrograde tenths of seconds hand at the centre. The hand points towards a graduation closed on 360°. The arrangement at the centre is not optimal; the tenths of seconds hand risks being hidden by the hour or minute hands. Furthermore, the multiplication of the hands around a same axis does not make for very intuitive reading; the user must know which hand indicates which unit. This solution is thus at most suited for displaying the counter's tenths of seconds.

EP1024416 describes a mechanical chronograph watch allowing fractions of seconds to be displayed by means of a retrograde hand on a small open graduation at 12 o'clock. The purely mechanical construction, where the retrograde hand is returned by means of a snail that is hard to machine, restricts considerably the reading resolution that can be indicated. The described watch indicates only the fifths of seconds.

EP1211579 concerns a movement having small non-retrograde hands that allow, in one mode, the tenths of seconds from the chronograph to be displayed.

Similarly, EP1085384 describes another movement having small non-retrograde hands that also allow the tenths of seconds from the chronograph to be displayed. EP130150 describes an electronic chronograph watch allowing the hundredths of seconds to be displayed by means of a non-retrograde hand at the centre.

CH61025 describes a chronograph watch having a retrograde minute hand. This watch does not allow fractions of seconds to be displayed.

WO02/093273 concerns a chronograph watch with a retrograde display of the seconds and a window for displaying the hours and minutes in numeric form. This watch again does not allow fractions of seconds to be displayed.

U.S. Pat. No. 5,959,941 describes an electronic chronograph watch having a retrograde seconds hand of the chronograph. This watch again does not allow fractions of seconds to be displayed.

One aim of the present invention is thus to propose a chronograph watch characterized by a new principle for displaying the counted period. One aim of the present invention is in particular to improve the legibility of the chronograph's indications, in particular the tenths or even the hundredths of seconds, thus allowing the user to read and access more rapidly the sought information. Another aim is to increase the resolution of the displayed durations, this without impairing the legibility.

Another aim of the present invention is to limit the current consumption caused by the displacement of the hands in chronograph mode.

Another aim is to propose an alternative solution, preferably more intuitive, to the problem of the indication of durations counted by a chronograph.

BRIEF SUMMARY OF THE INVENTION

According to the invention, these aims are achieved, among others, by means of a chronograph watch having a first retrograde hand for indicating the tenths of seconds of the chronograph and a second retrograde hand for indicating the hundreds of seconds of the chronograph.

This solution has the advantage of using at least one particular additional hand for indicating the fractions of seconds of the chronograph. It is thus possible to keep the hands at the centre to display for example the hours, minutes and seconds counted by the chronograph. The display is thus more intuitive.

Furthermore, the fractions of seconds are indicated by retrograde hands that can be de-centered and of small size, and that can move slightly at the end of a measurement only. The electric consumption caused by displaying fractions of seconds is thus minimized.

Moreover, considerable duration variations are indicated by the large hands at the centre, which the user is in any cased used to read, whilst only the fractions of seconds are indicated on sub-dials. Possible errors in reading due to the lack of legibility of the small dials consequently have any influence only on the smaller fractions of the measured duration.

Using two distinct graduations for the tenths and the hundredths of seconds allows large-size indexes to be placed along these two graduations.

BRIEF DESCRIPTION OF THE DRAWINGS

The invention will be better understood by reading the description of an embodiment illustrated by the attached figures in which.

DETAILED DESCRIPTION OF THE INVENTION

Figure 1:
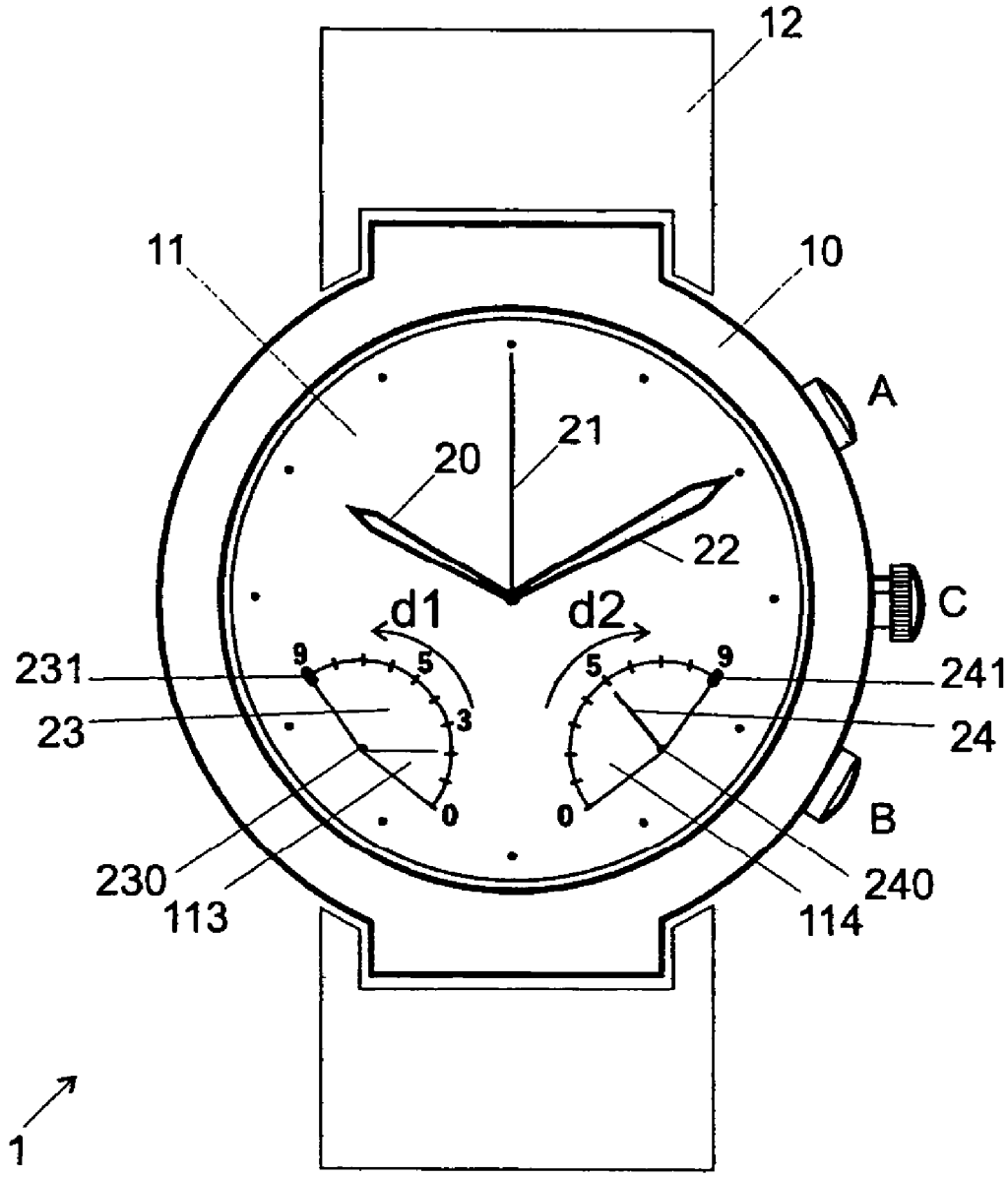
FIG. 1 illustrates by way of example a chronograph watch comprising a retrograde display according to the invention.

FIG. 1 illustrates by way of example a chronograph watch 1 according to one embodiment of the invention. The illustrated watch comprises a wristlet 12 and a case 10 including an electronic movement, not represented, for driving the hands 20 to 24 above a dial 11. A winding push-button C and two push-buttons A, B on one flank of the case allow to control the chronograph, to set the watch and to control auxiliary functions.

The hands 20 to 24 include:

A conventional hours hand 20 at the centre, driven to complete a revolution of the dial in 12 hours in time display mode and in chronograph mode.

A conventional minutes hand 22 at the centre, driven to complete a revolution of the dial in 60 minutes in time display mode and in chronograph mode.

A conventional seconds hand 21 at the centre, driven to complete a revolution of the dial in 60 seconds in time display mode and in chronograph mode.

A retrograde hand 23, turning around an axis 230 at about 7:30 o'clock and whose extremity points towards a double graduation 113 along an open circle segment.

In current-time display mode, the retrograde hand 23 indicates the tens of the date from 0 to 3; its position is thus incremented by one unit after the 9, 19 and 29 of each month. After the 28, 29, 30 or 31, depending on the number of days of the month, the hand returns to its initial position 0.

In chronograph mode, the retrograde hand 23 indicates the tenths of seconds from 0 to 9 of the duration counted by the chronograph. The extremity of the hand is oriented towards the corresponding graduation at the end of the measurement, for example at the end of counting or in intermediary time display, then returned to its initial position 0 following a resetting of the counter.

The graduation 113 is preferably regular along a segment of circle between 90 and 180°, for example a segment of circle of 162°. The hand 23 is incremented by turning anticlockwise d1 and reinitialized in opposite direction.

A retrograde hand 24 turning around an axis 240 at about 4:30 o'clock and whose extremity points towards a graduation 114 along an open circle segment. In current-time display mode, the retrograde hand 24 indicates the units of the date from 0 to 9; its position is thus incremented by one unit at midnight each day. After the 28, 29, 30 or 31, depending on the number of days of the month, the hand 24 returns to its initial position 0.

In chronograph mode, the retrograde hand 24 indicates the hundredths of seconds from 0 to 9 of the duration counted by the chronograph. The extremity of the hand is oriented towards the corresponding graduation at the end of the measurement, for example at the end of counting or in intermediary time display, then returned to its initial position 0 following a resetting of the counter.

The graduation 114 is preferably regular along a segment of circle between 90 and 180°, for example a segment of circle of 162°. For reasons of legibility, of optimal arrangement of the dial and aesthetics, the graduation 114 is preferably placed symmetrically to the graduation 113 relative to a symmetry axis 6 o'clock-12 o'clock. The hand 24 is thus incremented by turning clockwise d2 and reinitialized in opposite direction The watch illustrated in FIG. 1 thus indicates that it is 10 hours, 10 minutes 0 seconds and that the date is the $25^{th}$ if the watch is in time display mode. If the watch is in stopped chronograph mode, it indicates a duration of 10 hours 10 minutes, 0 seconds, 25 hundredths.

In a variant embodiment, not represented, the date is indicated in a more conventional fashion in one or several windows in time display mode as well as in chronograph mode. The hands 23 and 24 can then be used for displaying other indications in time display mode, for example power reserve, an indication measured by an additional physical sensor, etc.

The five hands 20 to 24 are preferably driven by five independent stepping motors. In one embodiment, the three hands at the center 20 to 22 are driven by a single stepping motor that directly drives the seconds hand 21 and, through gears, the minutes hand 22 and the hours hand 20.

It will be noted that the three hands 20 to 22, placed at the centre in concentric fashion, are driven at the same angular speed in time display mode and in chronograph mode. It is thus possible to optimize each motor driving these hands for a single speed and thus to reduce the cost of these motors, their space requirement and their consumption relatively to motors designed to function at different angular speeds. It is furthermore not necessary to use bidirectional motors for these functions. In this case, the return to 12 o'clock of the three central hands will always be performed in clockwise direction.

The retrograde hands 23 and 24 are however driven by bidirectional stepping motors, i.e. motors capable to turn in the direct direction d1 resp. d2 or in the retrograde direction according to the supplied control pulses. The direct direction d1 of the motor driving the hand 23 is anticlockwise whilst the direct direction d2 of the motor of the hand 24 is the clockwise direction. The retrograde direction is the direction inverted to the direct direction for each of the two motors. Both motors can be optimized to reduce the consumption in the usual direct direction and to increase the speed in the retrograde direction, where a fast return to the initial position is advantageous.

The hands 23 and 24 return to their respective initial position by applying on the corresponding motor a number of retrograde pulses equal to the number of direct pulses used for moving them towards their current angular position, which allows consumption to be minimized. In one embodiment, the resetting of the retrograde hands 23 respectively 24 is performed by sending a number of retrograde pulses greater than the required minimum, whereas the initial position is then determined by the mechanical bankings 231 respectively 241.

It will be noted that displaying the durations of the counter is particularly legible and intuitive since the hours, minutes and seconds of the chronograph are indicated by the hands allocated to these same tasks in time display mode.

The arrangement close to the side of the dial of the axes 230 resp. 240 of the motors driving the retrograde hands 23, 24 allows them to be moved away from the motors that drive the central hands and thus to better use the space available. The graduations 113, 114 on the segments of circle with a relatively large radius, capable of moving closer to that of the minutes graduation, allow the indexes from 1 to 9 to be spaced considerably further and thus legible indexes to be used even for displaying the tenths and hundredths of seconds.

It will be understood that retrograde displays can in fact be arranged at any place on the dial, for example at 9 o'clock and at 3 o'clock, or even on the two upper quarters of the dial, i.e. at 10:30 o'clock and at 1:30 o'clock, or even at noon or at 6 o'clock or at the centre for example. Furthermore, several retrograde displays with radiuses and/or segments of circle or of curve of variable angular width can be used. It is also possible within the frame of the invention to use several concentric retrograde hands and/or retrograde hands at the centre. These additional displays allow for example additional data of the chronograph, for example thousandths of seconds, one or several intermediary times, a count down etc. and/or indications of the watch in modes other than the chronograph mode to be indicated. The occupation of the two lower quadrants of the dial has however the advantage of reducing the risk of one or the other of the sub-dials being partly dissimulated in chronograph mode by the hours or minutes hands in the frequent case of short duration counts.

Figure 2:
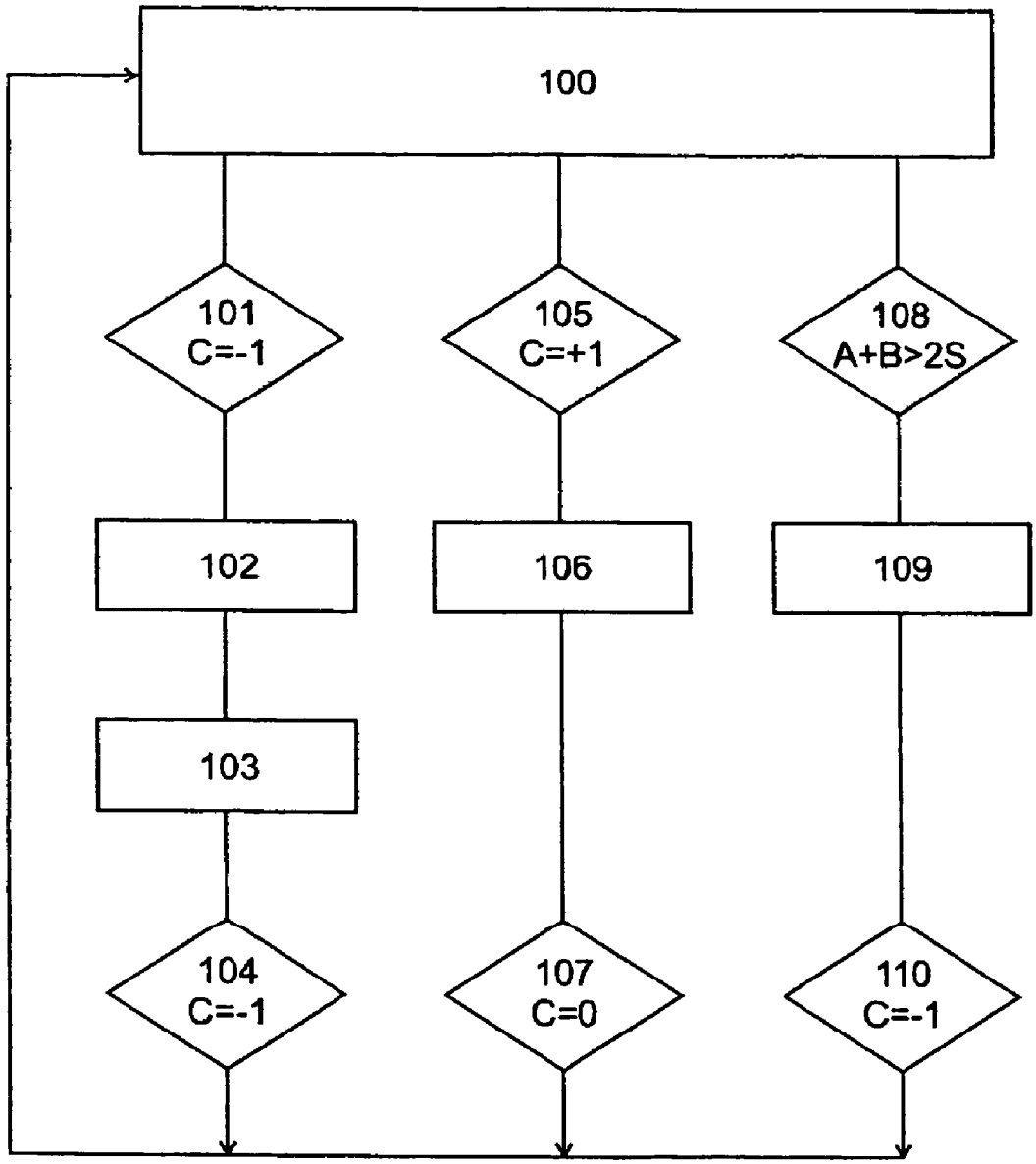
FIG. 2 is a state diagram illustrating the transitions between three possible operation modes of the inventive chronograph watch.

FIG. 2 is a state diagram illustrating the transitions between three possible operation modes of the inventive chronograph watch 1 of the invention, comprising three control organs of which two push-buttons A and B and a winding push-button C. Initially, the watch is in state 100 to display the current time with the hands 20, 21, 22 and the two date elements with the retrograde hands 23 and 24. By pressing during step 101 on the winding push-button C (pushed-down position C=−1), the watch switches to chronograph mode. The chronograph is first re-initialized (step 102) to set both retrograde hands 23 and 24 at their initial position at 0 or in another particular position. The hands at the centre 20 to 22 go to 12 o'clock. Simultaneously, the state of the electronic counters (not represented) that count the measured duration is re-initialized at zero.

After this initialization phase 102, the watch 1 then switches to chronograph mode during step 103. The chronograph mode is illustrated in detail in FIG. 6 and will be discussed further below. The watch 1 then returns in time display mode 100 when a new pressing on the winding push-button C is detected during step 104. Other events can be used for effecting the transition 104.

During step 105, the watch switches from the time display state 100 to the hour setting state when the winding push-button C is pulled outwards in position C+1. The time displayed by the hands at the centre 20-22 can then be corrected by turning the winding button in one direction whilst the date displayed by the retrograde hands 23, 24 can be corrected by turning the winding button C in the other direction during the step 106. Other time or date correction means, for example by means of the push-buttons A and B, can also be implemented. Furthermore, a direct switch from the chronograph mode 103 to the time setting mode 106 can also be conceived by pulling the winding button C outwards.

The watch then returns to the time display mode by pressing during the step 107 on the winding button to replace it in the stable intermediary position (C=0).

During the step 108, the watch switches from the time display state 100 to the hand synchronization state 109 when both push-buttons A and B are pressed simultaneously during at least a predetermined period, for example during at least two seconds. This mode makes it possible to set back at 12 o'clock the hours, minutes and seconds hands. In particular, it makes it possible to ensure that the hours hand points exactly at 12 o'clock when the minutes hand is at noon, and that the minutes hand also points at 12 o'clock when the seconds hand is at noon. During the step 109, the hands 20, 21 and 22 can be displaced independently from one another by means of the push-buttons A and B for example. The watch then returns in time display mode for example by briefly pressing on the winding push-button C.

Figure 3:
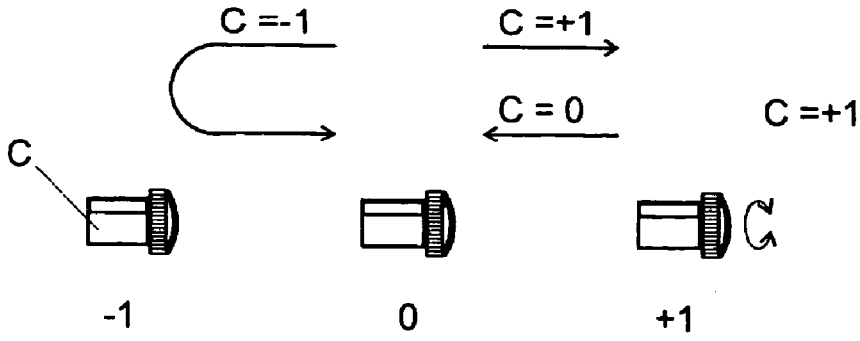
FIG. 3 illustrates diagrammatically the three axial positions of the winding push-button of the inventive chronograph watch.

FIG. 3 illustrates diagrammatically the three axial positions C=−1, C=0 and C=+1 which can be taken up by the winding push-button C of the chronograph watch. The intermediary axial position C=0 is stable and is used both in time display mode as in chronograph mode; the switching from one of these to modes to the other is performed by pressing briefly on the winding push-button C until it reaches the instable pushed-down position C=−1 and returns of itself under the action of a spring towards the stable position C=0.

The pulled-out position C=+1 is stable and is reached by puling the winding button C outwards to switch to time setting mode. It is recalled symbolically on FIG. 3 that in position C=+1, the winding button's rotation allows the time and date to be corrected, as indicated previously. The watch returns in time display mode respectively chronograph mode by pressing again on the winding push-button C to replace it at the intermediary position C=0.

Figure 4:
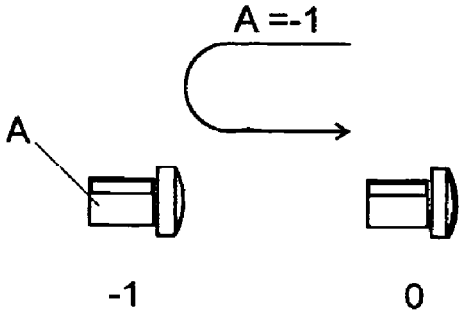
FIG. 4 illustrates diagrammatically the two axial positions of a first push-button of the inventive chronograph watch.

FIG. 4 illustrates diagrammatically the two axial positions A=−1 and A=0 that can be taken up by the monostable push-button A. Only the external position A=0 is stable and the push-button A returns of itself to this position as soon as it is released from the pushed-down position A=−1. The push-button A allows notably to start or interrupt the counter in chronograph mode.

Figure 5:
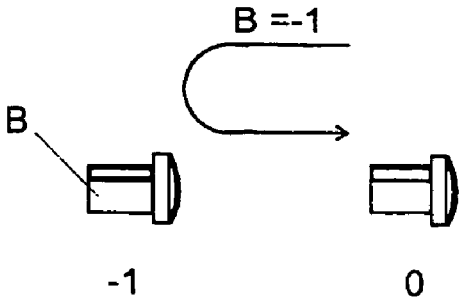
FIG. 5 illustrates diagrammatically the two axial positions of a second push-button of the inventive chronograph watch.

FIG. 5 illustrates diagrammatically the two axial positions B=−1 and B=0 that can be taken up by the monostable push-button B. Only the external position B=0 is stable and the push-button B returns of itself to this position as soon as it is released from the pushed-down position B=−1. The push-button B allows notably to provisionally interrupt the counter to display an intermediary time in chronograph mode.

Figure 6:
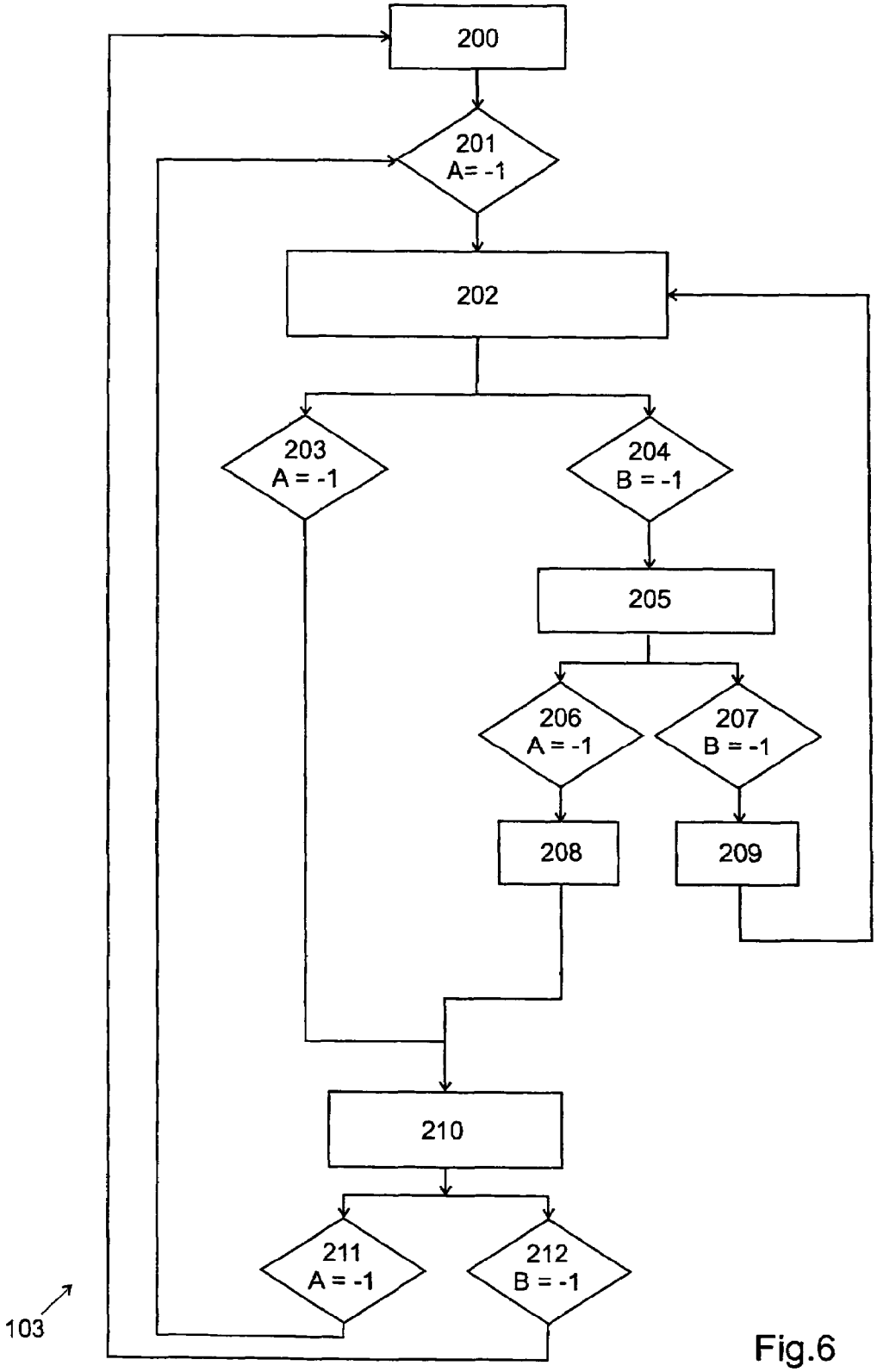
FIG. 6 is a flux diagram showing the operation in chronograph mode of the inventive watch.

FIG. 6 is a flux diagram illustrating the functioning in chronograph mode 103 of the inventive watch. The user arrives in chronograph mode from the time display mode 100 by briefly pressing on the winding push-button C, as described above in relation with FIG. 2. The 5 hands are in their initial position and point towards zero, and the chronograph waits during the stage 200 that the user starts a duration counting by pressing on the push-button A or that he returns in current time display mode by pressing again on the winding push-button C (transition not represented).

As soon as the user presses briefly on the push-button A (step 201), the chronograph is started and one or several electronic counters within the movement are incremented each hundredths of a second (step 202). The seconds hand 21, minutes hand 22 and hours hand 20 are moved during the measurement in order to indicate the state of the counter; the retrograde hands 23 and 24 remain however unmoving.

When the use presses again on the push-button A (step 203), the counter's incrementing is interrupted. The hands at the center 20, 21, 22 are immediately immobilized whilst the retrograde hands 23 and 24 move to point towards the positions corresponding to the tenth respectively hundredth of second reached by the counter (step 210). The user can then read very comfortably the counted duration (total time) by means of the 5 hands 20-24.

When, from the counting state 202, the user presses on the push-button B (step 204), the hands at the center 20, 21, 22 are immediately immobilized whilst the retrograde hands 23 and 24 move to point towards the positions corresponding to the tenth respectively hundredth of second reached by the counter at the time the button was pushed (step 205). The incrementing of the electronic counter is however continued during this step.

If, from this position 205 of intermediary time display, the user presses on the push-button A (step 206), the chronograph is stopped. The counter's incrementing is then interrupted during the step 208 and the watch reaches again the state 210 of total time display.

If however the use presses again on the push-button B (step 207), the seconds, minutes and hours hands regain the current position reached by the counter whilst the retrograde hands return to zero (step 209). The chronograph then returns to the state 202 to indicate the counted duration and continue the duration counting.

From the state 210 (stopped chronograph indicating a total time), pressing on the push-button A (step 211) allows the chronograph to revert to step 201 to start the counting of a new and non-consecutive duration; the counter and the hands then indicate the total duration counted during all the preceding measuring cycles. Pressing on the push-button B (step 212) allows on the other hand the chronograph to be reset and all the hands to be brought back to their initial position, without however leaving the chronograph mode, i.e. returning to the step 200.

The watch preferably includes a quartz movement with a 30 millimeters' diameter. The indications displayed by the retrograde hands in time display mode or in other additional modes can preferably be personalized after the movements manufacturing, for example by programming, to ensure a greater versatility.

The invention claimed is:

1. A chronograph watch including a first retrograde hand and indicia representing tenths of seconds for indicating the tenths of seconds of the chronograph and a second retrograde hand and indicia representing hundredths of seconds for indicating the hundredths of seconds of the chronograph.

2. The watch of claim 1, wherein said retrograde hands revert to an initial position by means of an angular displacement in the opposite direction to the sense of rotation used during a measurement operation.

3. The watch of claim 1, wherein the first retrograde hand is placed at one location and moves along an incremental graduation progressing anticlockwise during a measurement operation, and wherein the second retrograde hand is placed approximately at a different location and moves along an incremental graduation progressing clockwise during said measurement operation.

4. The watch of claim 1, the extremity of said hands moving along at least one open curve.

5. The watch of claim 1, further including: an hours hand for indicating according to the mode either the hours counted by the chronograph or the current hour, a minutes hand for indicating according to the mode either the minutes counted by the chronograph, or the current minute, a seconds hand for indicating according to the mode either the seconds counted by the chronograph or the current second.

6. The watch of claim 5, including at least two push-buttons allowing, by simultaneous pushing on these two push-buttons during a predetermined period, the retiming at 12 o'clock of the hours, minutes and seconds hand.

7. The watch of claim 5, said hours, minutes and seconds hands being placed at the center in concentric fashion.

8. The watch of claim 1, including a movement arranged to drive at least one of said retrograde hands so as to leave it unmoving during the counting of a duration in chronograph mode and to move it at the end of said counting.

9. The watch of claim 1, capable of functioning according to a chronograph mode for counting said duration and according to at least one other mode, said at least one retrograde hand indicating another time indication in said other mode.

10. The watch of claim 9, said other mode being a current time display mode, said at least one retrograde hand displaying the date in said current time display mode.

11. The watch of claim 10, the tens of the date being displayed by a first retrograde hand and the units of the date by a second retrograde hand.

12. The watch of claim 1, wherein the extremity of the two retrograde hands moves along two symmetrical open curves relatively to the 6 o'clock-12 o'clock axis of the dial.

13. The watch of claim 12, said two retrograde hands being placed under the 3 o'clock-9 o'clock axis of the dial.

14. The watch of claim 13, wherein: the first retrograde hand is placed approximately at 7:30 o'clock and moves along an incremental graduation progressing anticlockwise, the second retrograde hand is placed approximately at 4:30 o'clock and moves along an incremental graduation progressing clockwise.

15. The watch of claim 1, wherein one said retrograde hand progresses in anticlockwise direction and the other said retrograde hand progresses in clockwise direction.

16. The watch of claim 1, comprising a winding push-button or control organ with three axial positions including a stable intermediary axial position, a temporary pushed-down axial position causing a switch from the chronograph mode to another display and/or a switch from said other display mode to the chronograph mode, a stable pulled-out axial position allowing the time of said watch to be corrected.

17. The watch of claim 1, including a control organ for switching from a time display mode to the chronograph mode, at least one retrograde hand being displaced towards a predetermined reference position during the switch to chronograph mode.

18. The watch of claim 17, including hands at the center for displaying the hour, the minute and the seconds, said hands at the center being displaced towards a predetermined reference position during the switch to chronograph mode.

19. The watch of claim 17, including a first control organ for starting the counting of a duration by said chronograph, and at least one control organ for displacing said at least one retrograde hand so as to have it indicate the fraction of second counted at the time of actuation.

20. The watch of claim 19, at least one retrograde hand remaining unmoving during said counting.

21. The watch of claim 1, at least one retrograde hand being actuated by a bidirectional stepping motor.

22. The watch of claim 21, said stepping motor being capable of turning in the direct direction or in the retrograde direction according to the supplied control pulses, the rotation speed of said stepping motor in the retrograde direction being different from the corresponding values in the direct direction.

23. The watch of claim 22, the two retrograde hands being controlled each by a distinct stepping motor, the direct direction of one of the two stepping motors being the clockwise direction whilst the direct direction of the other motor being the anticlockwise direction, the rotation speed of both stepping motors in the retrograde direction being equal.

24. The watch of claim 1, the two retrograde hands allowing an indication of duration to be displayed in a chronograph mode and another indication in another mode.

25. The watch of claim 1, including at least one mechanical banking to ensure the return of at least one retrograde hand to a predetermined reference position.

26. Electromechanical watch movement including two bidirectional motors each driving a respective retrograde hand for indicating the fractions of second of a duration counted by the chronograph, wherein one retrograde hand points to indicia on a watch face representing tenths of seconds, and wherein another retrograde hand points to indicia on the watch face representing hundredths of seconds.

27. The watch of claim 26, wherein said retrograde hands revert to an initial position by means of an angular displacement in the opposite direction to the sense of rotation used during a measurement operation.

28. A chronograph watch capable of operating in at least two modes, said watch including:

an hours hand for indicating according to a first mode the hours counted by the chronograph and according to a second mode the current hour, a minutes hand for indicating according to the first mode the minutes counted by the chronograph, and according to the second mode the current minute, said hours and minutes hands being placed at the center of said watch, a first retrograde hand moving along a first open curve with indicia representing tenths of seconds for indicating the tenths of seconds of the chronograph, and a second retrograde hand moving along a second open curve with indicia representing hundredths of seconds for indicating the hundredths of seconds of the chronograph.

29. A watch including: an hours hand and a minutes hand both placed at the center of said watch, a first retrograde hand placed approximately at 7:30 o'clock and moving along an incremental graduation progressing anticlockwise, a second retrograde hand placed approximately at 4:30 o'clock and moving along an incremental graduation progressing clockwise.

30. A chronograph watch including:

a first retrograde hand for indicating the tenths of seconds of the chronograph and a second retrograde hand for indicating the hundredths of seconds of the chronograph, wherein said watch is capable of functioning according to a chronograph mode for counting said duration and according to at least one other mode, said at least one retrograde hand indicating another time indication in said other mode, and wherein said other mode is a current time display mode, said at least one retrograde hand displaying the date in said current time display mode, and further wherein the tens of the date are displayed by a first retrograde hand and the units of the date are displayed by a second retrograde hand.

31. The watch of claim 30, wherein said retrograde hands revert to an initial position by means of an angular displacement in the opposite direction to the sense of rotation used during a measurement operation.

32. A chronograph watch including:

a first retrograde hand and indicia representing tenths of seconds for indicating the tenths of seconds of the chronograph; and a second retrograde hand and indicia representing hundredths of seconds for indicating the hundredths of seconds of the chronograph, wherein the extremity of the two retrograde hands moves along two symmetrical open curves relatively to the 6 o'clock-12 o'clock axis of the dial, and wherein said two retrograde hands are placed under the 3 o'clock-9 o'clock axis of the dial, and wherein the first retrograde hand is placed approximately at 7:30 o'clock and moves along an incremental graduation progressing anticlockwise, and the second retrograde hand is placed approximately at 4:30 o'clock and moves along an incremental graduation progressing clockwise.

* * * * *